US006102231A

United States Patent [19]

Rider, Jr. et al.

[11] Patent Number: 6,102,231

[45] Date of Patent: Aug. 15, 2000

[54] CONTAINER CLOSURE SYSTEM

[75] Inventors: Edward W. Rider, Jr., Slate Hill; Brian S. Allers, Poughkeepsie, both of N.Y.

[73] Assignee: Genpak, L.L.C., Glens Falls, N.Y.

[21] Appl. No.: 09/273,753

[22] Filed: Mar. 22, 1999

Related U.S. Application Data

[63] Continuation of application No. 08/941,900, Sep. 30, 1997, Pat. No. 5,950,854.

[51] Int. Cl.[7] ..... B65D 6/00

[52] U.S. Cl. ..... 220/4.23; 220/339

[58] Field of Search ..... 220/4.23, 324, 220/337, 339

[56] References Cited

U.S. PATENT DOCUMENTS

| | | | |
|---|---|---|---|
| 3,876,130 | 4/1975 | Haase | 220/4.23 X |
| 4,915,251 | 4/1990 | Payne | 220/4.23 |
| 5,092,479 | 3/1992 | Wells | 220/4.23 |
| 5,950,854 | 9/1999 | Rider, Jr. et al. | 220/4.23 |

*Primary Examiner*—Steven Pollard
*Attorney, Agent, or Firm*—Heslin & Rothenberg, P.C.; Wayne F. Reinke

[57] ABSTRACT

A container (e.g., for food) has a top portion, a bottom portion connected to the top portion by a hinge, and a closure opposite the hinge. The closure is a tab-and-slot type, with the tab curved in a direction away from the slot to encourage closing and discourage opening of the container. A beveled edge on the top surface serves as a designated pressure-application area for a user's thumb, assisting with opening and/or closing of the closure with one hand. Mating step-type peripheral flanges in the top and bottom slope upward from the hinge to the closure to create a multi-level seal that gets larger near the closure. The step shape of the top flange also helps create a channel in the top that catches any liquid spilled on the container, and barriers on either side of the closure in the channel discourage the liquid from entering the container through the closure.

29 Claims, 5 Drawing Sheets

CONTAINER CLOSURE SYSTEM

This application is a continuation of prior U.S. Application Ser. No. 08/941,900, filed Sep. 30, 1997, now U.S. Pat. No. 5,950,854, which application is incorporated fully herein by reference.

BACKGROUND OF THE INVENTION

1. Technical Field

The present invention generally relates to containers, such as food containers. More particularly, the present invention relates to a closure system for containers.

2. Background Information

Users of containers, and, in particular, users of food containers, such as restaurants, have searched for containers that are easier to use while still adequately containing the contents. For restaurants, such as fast food restaurants, ease of use of a given food container helps determine the speed of the food preparation line. In the past, food containers have included closures that were unreliable and/or difficult to manipulate, often requiring both hands to open and/or close. Therefore, it would be helpful to such users to have a container with a reliable closure that can be operated with one hand.

In addition, a user often encounters liquid spilling on the container and contaminating the contents, for example, by entering through the closure. This is especially true in food preparation. It would be helpful to such users to have a container designed to reduce or eliminate such potential liquid contamination.

Still further, the users of such containers may experience unwanted gaps in the container seal, which allows excess ambient air into the container and/or allows the contents of the container to escape. In the food preparation situation, although a modest amount of ventilation helps reduce condensation, too much can make the food unsavory (e.g., by drying out). Clamshell-type food containers with a flat, horizontal peripheral flange seal may experience such unwanted gaps. Therefore, it would be helpful if a more reliable seal were available.

Thus, a need exists for an improved container closure system addressing one or more of the above-noted problems.

SUMMARY OF THE INVENTION

Briefly, the present invention satisfies the need for an improved container closure system by providing a container with, among other things, a designated pressure-application area for assisting with opening and/or closing of the container closure, a channel around the top to catch spilled liquid with barriers on either side of the closure in the channel to discourage entry of the liquid into the container, and/or upper and lower correspondingly shaped peripheral flanges sloping upward from the back of the container toward the front closure area.

In accordance with the above, it is an object of the present invention to provide a container with an improved closure system.

It is another object of the present invention to provide a container that can be reliably opened/closed with one hand.

The present invention provides, in a first aspect, a container, comprising a top portion, a bottom portion connected to the top portion by a hinge, and a closure opposite the hinge. At least one of the top and bottom portions comprises a designated pressure-application area for assisting with opening and/or closing of the closure.

The present invention provides, in a second aspect, a container, comprising a top portion, a bottom portion connected to the top portion by a hinge, a closure opposite the hinge, a channel extending around at least a part of the top portion including the closure, and a barrier on either side of the closure in the channel to discourage liquid from entering the container through the closure.

The present invention provides, in a third aspect, a container, comprising a top portion including a first flange about part of a periphery thereof, a bottom portion connected to the top portion by a hinge, the bottom portion also including a second flange about part of a periphery thereof, and a closure opposite the hinge. The first and second flanges have corresponding shapes and slope upward in a direction toward the closure.

These, and other objects, features and advantages of this invention will become apparent from the following detailed description of the various aspects of the invention taken in conjunction with the accompanying drawings.

BEST MODE FOR CARRYING OUT THE INVENTION

Figure 1:
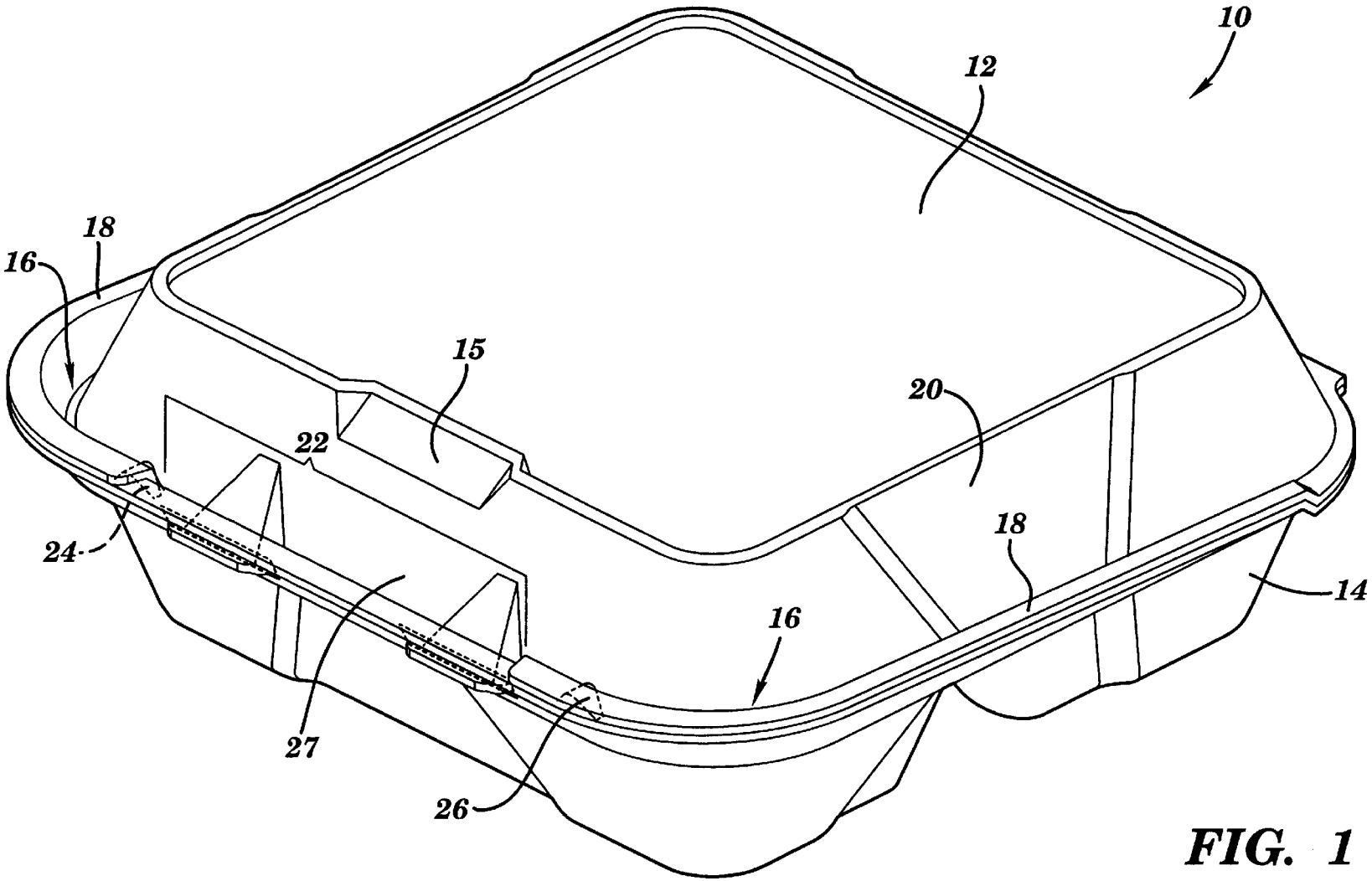
FIG. 1 depicts a container according to the present invention. is

FIG. 1 is a perspective view of a container 10 according to the present invention. Container 10 comprises a top portion 12 and a bottom portion 14 connected by a hinge (see FIG. 5). Container 10 further comprises a beveled edge 15, and a channel 16 formed by upper flange 18 and the main part 20 of top portion 12. Within channel 16 on either side of closure area 22 are barriers 24 and 26.

Beveled edge 15 serves as a designated pressure-application area to assist with opening and/or closing the container, and more specifically, assist with manipulating the closure, which in the present embodiment takes the form of a tab and opening, as discussed in more detail below. As shown, the pressure-application area is separate from the closure, i.e., it is not directly connected to or part of the actual closure. As used herein, the term "designated" refers to a physical designation, i.e., an area in or on the structure designed for pressure application. It will be understood that the designated pressure-application area could take other forms or be located elsewhere, so long as it serves the stated purpose and is separate from the closure. For example, a designated pressure-application area could instead be located further down side 27, just above the closure. In actual use, a user could open/close container 10 with one hand by grasping top portion 12, with the user's thumb resting on beveled edge 15. By applying pressure with the thumb, side 27 will deform slightly so as to allow the closure tabs to enter or exit their corresponding openings or slots.

Channel 16 serves to catch any liquid that may be spilled on the container, while barriers 24 and 26 discourage the liquid from entering the container through closure area 22.

Although barriers 24 and 26 are each shown in FIG. 1 shaped as an upside down and rounded "V", it will be understood that they could take any number of forms, so long as they discourage liquid entry into the container.

Container 10 could be, for example, a food container. Although container 10 could be made of various materials, it is preferably made of foamed or unfoamed plastic. However, where container 10 is used as a food container, the container material must of course be suitable (under current standards) for contact with food, for example, polystyrene or poly(ethylene terephthalate) (also known as "PET").

Figure 2:
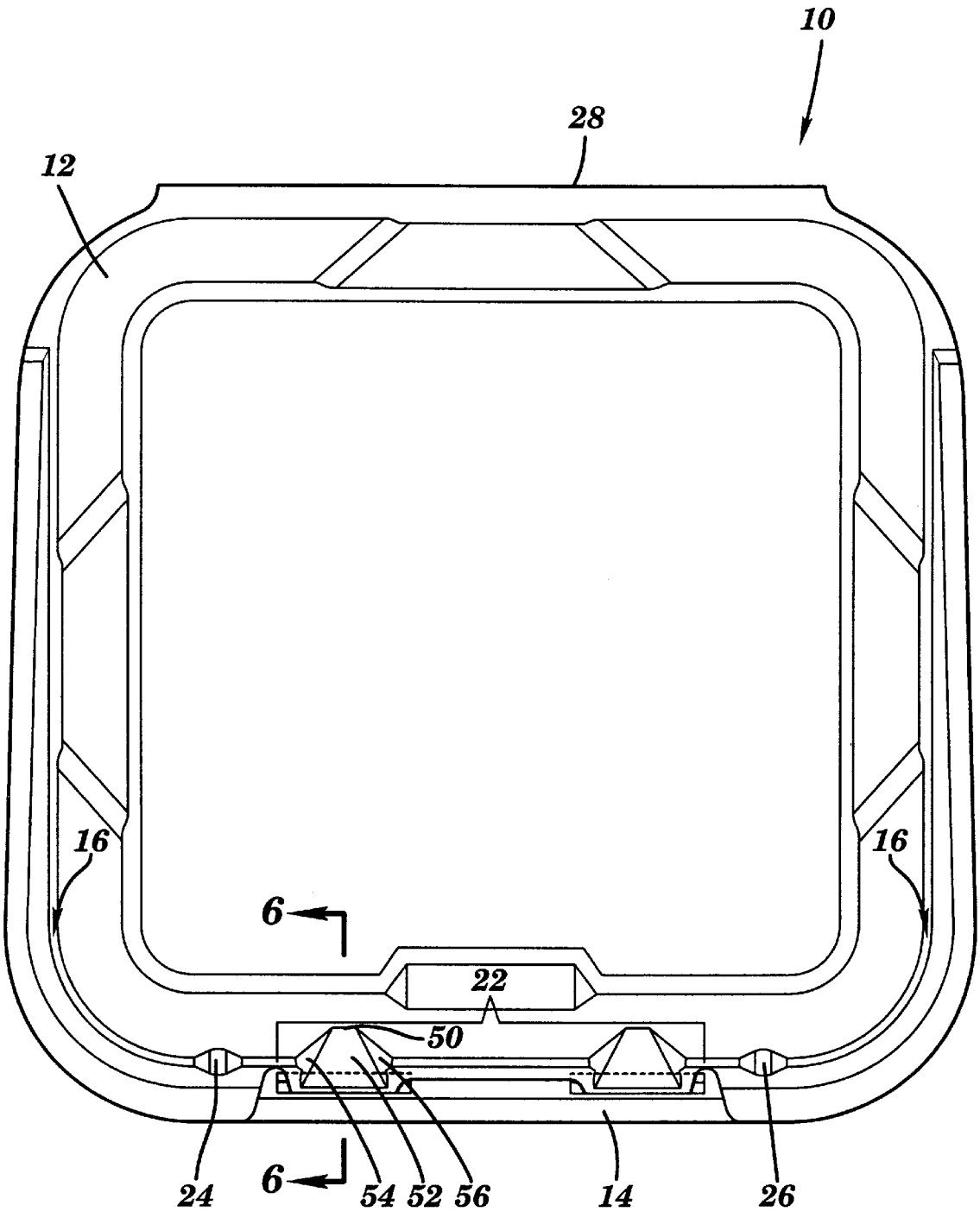
FIG. 2 is a top view of the container depicted in FIG. 1.

FIG. 2 depicts container 10 from above. As shown in FIG. 2, channel 16 begins near hinge 28 and ends at barriers 24 and 26 on either side of closure area 22. Where other forms of closures are used, the channel may extend more or less into the closure area.

Figure 3:
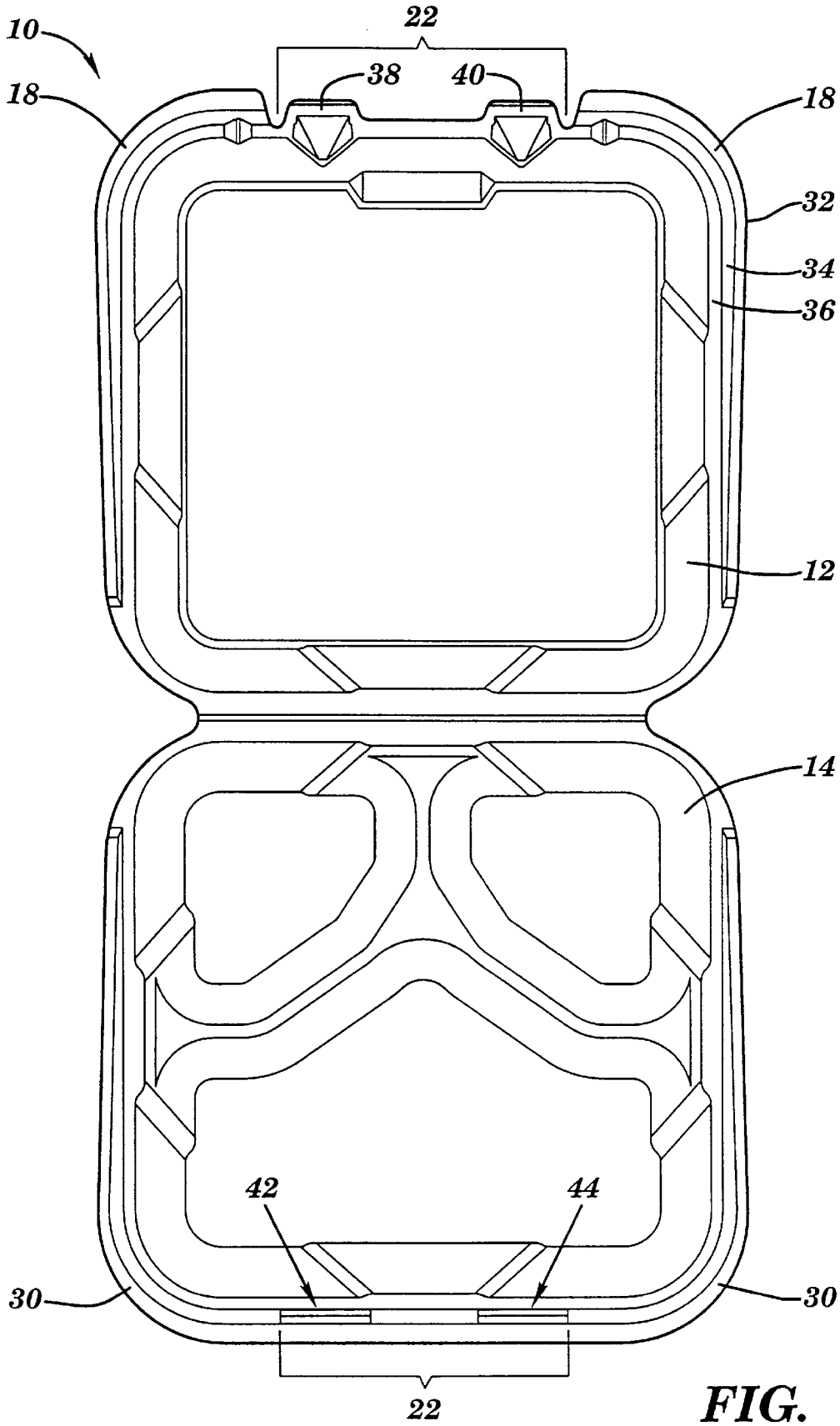
FIG. 3 is a top view of the interior of the container depicted in FIG. 1.
Figure 4:
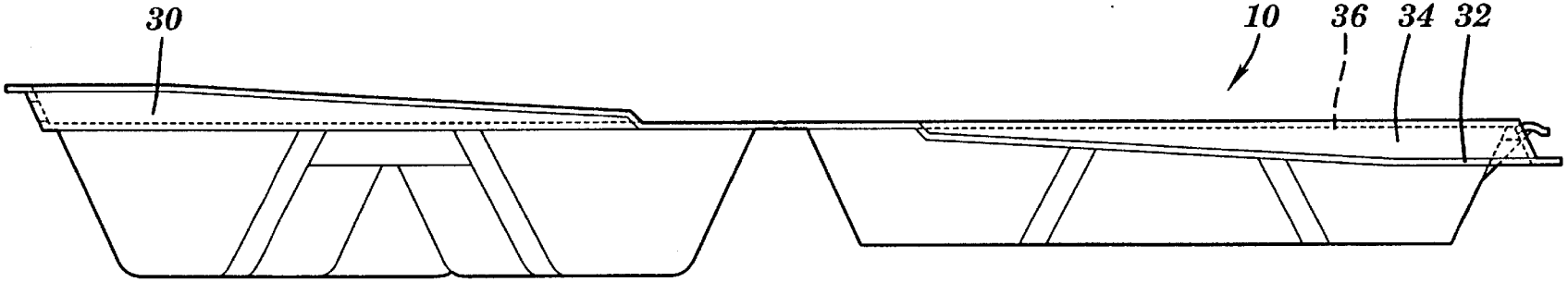
FIG. 4 is a side view of the container depicted in FIG. 3.

As shown in FIG. 3, which is a top view of the interior of container 10, the underside of flange 18, which partially forms channel 16, has a complementary shape to that of lower flange 30, i.e., the flanges are nestable. Flange 18 is discontinued in closure area 22, whereas flange 30 is not. In this case, each flange is roughly step shaped, providing three contact surfaces or levels, e.g., surfaces 32, 34 and 36. Surface 34 is roughly perpendicular to surface 32, and surface 36 is roughly perpendicular to surface 34. Each surface may be curved or flat, however, outermost surface 32 is preferably flat and "roughly perpendicular" means an angle between the given surfaces (or normals thereto, if curved) of between about 70° and about 110°.

Also shown in FIG. 3 are the undersides of tabs 38 and 40 in top portion 12, and openings 42 and 44 into which the tabs are inserted. The closure will be discussed in more detail below. However, it will be understood that the tabs and openings need not be on the top and bottom portions, respectively, but may be switched. Further, for purposes of the other inventive aspects of container 10, the closure could be a different type altogether. Still further, although container 10 is compartmentalized, it need not be, or could have different sizes and/or numbers and/or shapes of compartments.

When flanges 18 and 30 are brought together, a seal is created for the container. The area of the seal varies along its length, in this case continuously increasing from near the hinge to the closure area. A larger seal in the closure area compared to the area closer to the hinge provides an improved seal over a constant-area seal, since the seal for a clamshell-type container is more likely to have gaps the farther away from the hinge one gets. Increasing the possible contact surface area increases the likelihood of a proper seal.

Figure 5:
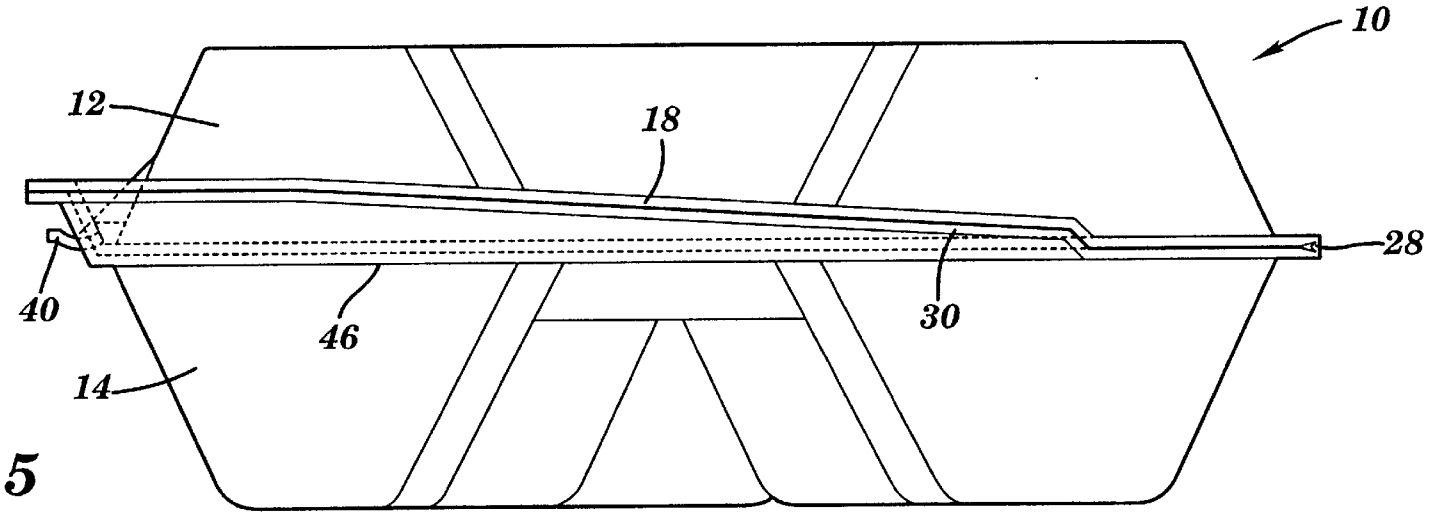
FIG. 5 is a side view of the container depicted in FIG. 1.

FIG. 5 is a side view of container 10. The upward slope of the upper portions of flanges 18 and 30 in the direction of the closure area is best appreciated in FIG. 5, and exemplary hinge 28 is best shown. It will be understood that other hinge designs could be used, and that hinge 28 is merely an example. Although the visible portions of the flanges slope upward toward the closure, it will be appreciated from FIG. 5 that the bottoms of the flanges (see bottom 46 of lower flange 30) are level. This enables the seal area to be larger in the front.

Figure 6:
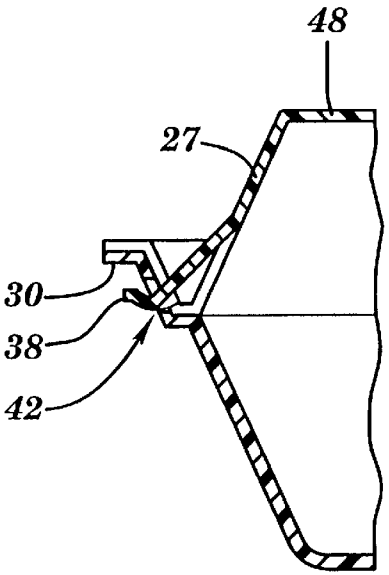
FIG. 6 is a cross-sectional view of the closure of the container depicted in FIG. 1.

FIG. 6 is a cross-sectional view of container 10 taken along the closure at lines 6—6. Tab 38 is curved upward to encourage closing and discourage opening. That is to say, if no pressure were applied at beveled edge 15, merely pressing downward on the top surface 48 of top portion 12 would cause the tabs, because of their shape, to flex side 27 outward until the tabs lined up with the openings, at which time side 27 would flex back and the tabs would be in their respective openings. Tab 38 fits into opening 42 and holds lower flange 30 within its curve, thereby providing a reliable and secure closure for container 10. This is especially advantageous where container 10 holds food. The tabs are connected to a structure 50 (see FIG. 2) extending out from side 27, which serves to strengthen the tabs against breakage when there is pressure on the tabs into the direction of the curves, in this case, in a downward direction. Structure 50 resembles an awning on a building and comprises a front portion 52 extending out from side 27, and two sides 54 and 56 connected to side 27. It will be understood that although container 10 is depicted with two individual tab and opening pairs, there could be one, or more than two of them, and the closure could even be of another type for purpose of other aspects of the invention.

Figure 7:
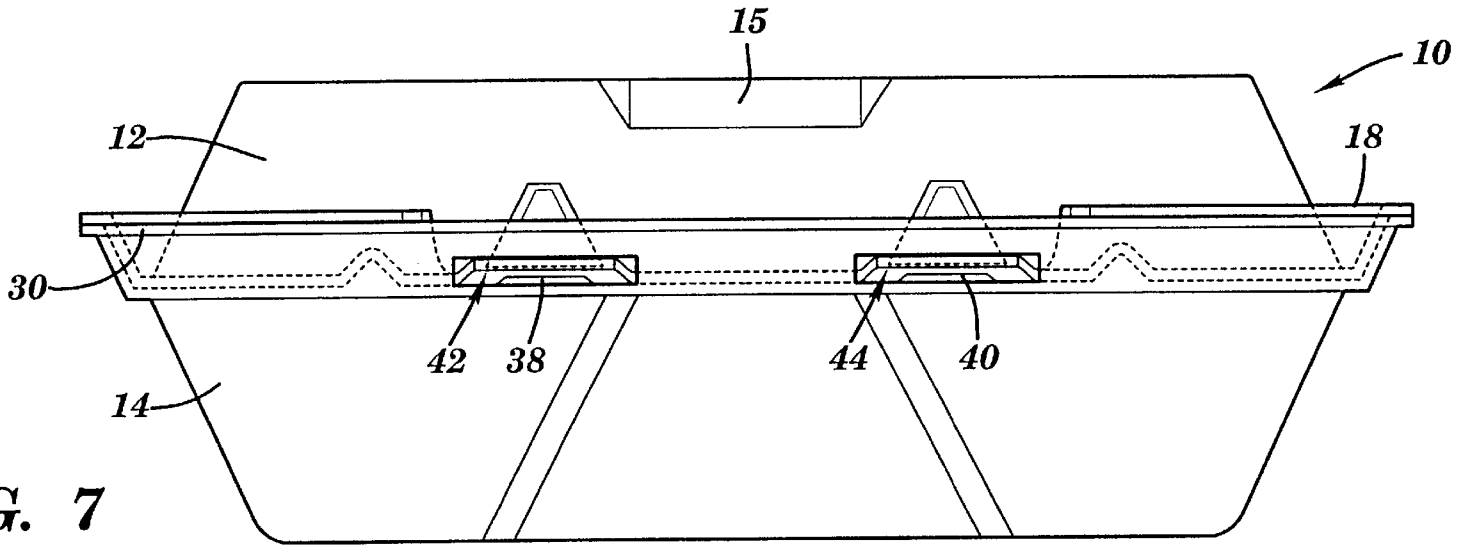
FIG. 7 is a front plan view of the container depicted in FIG. 1.

FIG. 7 is a front plan view of container 10. Openings 42 and 44, are somewhat larger than the thickness of tabs 38 and 40. This sizing difference allows for ease of insertion and removal of the tabs, and also provides a modest level of ventilation for container 10.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

What is claimed is:

1. A container, comprising:

a top portion;

a bottom portion connected to the top portion by a hinge; and a closure opposite the hinge;

wherein at least one of the top portion and the bottom portion comprises a beveled edge for pressure application separate from the closure for assisting with opening and/or closing of the closure.

2. The container of claim 1, wherein the closure comprises at least one tab extending outward from one of the top portion and the bottom portion and at least one opening in the other of the top portion and the bottom portion for accepting the at least one tab.

3. The container of claim 2, wherein the at least one tab is curved in a direction away from the opening to encourage closing and discourage opening of the closure.

4. The container of claim 1, wherein the closure comprises at least one tab extending outward from one of the top portion and the bottom portion and at least one opening in the other of the top portion and the bottom portion for accepting the at least one tab, and wherein the beveled edge is located on the one of the top portion and the bottom portion comprising the at least one tab.

5. The container of claim 1, further comprising:

a first flange around part of a periphery of the top portion;

a second flange around part of a periphery of the bottom portion;

wherein the first flange and the second flange are roughly step-shaped in cross section.

6. The container of claim 5, wherein each of the first flange and the second flange comprises a first surface, a second surface roughly perpendicular to the first surface, and a third surface roughly perpendicular to the second surface.

7. The container of claim 5, wherein the first flange and the second flange define a seal area of varying size, and wherein the seal area is largest near the closure.

8. The container of claim 5, wherein the first flange and a main part of the top portion define a channel in the top portion, the container further comprising a barrier on either side of the closure in the channel to discourage liquid from entering the container through the closure.

9. The container of claim 1, further comprising:

a first flange around part of a periphery of the top portion;

a second flange around part of a periphery of the bottom portion;

wherein part of the first flange and part of the second flange slope upward in a direction toward the closure.

10. The container of claim 1, wherein the container is a food container made of a material suitable for contact with food.

11. The container of claim 10, wherein the material comprises plastic.

12. The container of claim 11, wherein the material comprises foamed plastic.

13. The container of claim 12, wherein the material comprises foamed poly(ethylene terephthalate).

14. The container of claim 12, wherein the material comprises foamed polystyrene.

15. A container, comprising:

a top portion;

a bottom portion connected to the top portion by a hinge; and a closure opposite the hinge, wherein the closure comprises at least one tab extending outward from one of the top portion and the bottom portion and at least one opening in the other of the top portion and the bottom portion for accepting the at least one tab;

wherein at least one of the top portion and the bottom portion comprises a structurally designated pressure-application area comprising a beveled edge separate from the closure for assisting with opening and/or closing of the closure, wherein the top portion comprises the at least one tab, and wherein the beveled edge is located above and centered with respect to the at least one tab.

16. A container, comprising:

a top portion;

a bottom portion connected to the top portion by a hinge;

a closure opposite the hinge;

a channel extending around at least a part of the top portion in an area on either side of the closure; and a barrier separate from and on either side of the closure in the channel to discourage liquid from entering the container through the closure.

17. The container of claim 16, further comprising a designated pressure-application area separate from the closure on at least one of the top portion and the bottom portion for assisting with opening and/or closing of the closure.

18. The container of claim 17, wherein the designated pressure-application area comprises a beveled edge.

19. The container of claim 16, wherein the closure comprises at least one tab extending outward from one of the top portion and the bottom portion and at least one opening in the other of the top portion and the bottom portion for accepting the at least one tab.

20. The container of claim 19, further comprising a beveled edge on the one of the top portion and the bottom portion for assisting with opening and/or closing of the closure.

21. The container of claim 19, wherein the at least one tab is curved in a direction away from the at least one opening to encourage closing and discourage opening of the closure.

22. The container of claim 16, wherein the top portion comprises a first flange around part of a periphery thereof, wherein the bottom portion comprises a second flange around part of a periphery thereof, the first flange and the second flange defining a seal sloping upward in a direction toward the closure.

23. The container of claim 22, wherein the seal is of varying size, and wherein the seal is largest at the closure.

24. The container of claim 16, wherein the top portion comprises a first flange around part of a periphery thereof, wherein the bottom portion comprises a second flange around part of a periphery thereof, and wherein the first flange and the second flange are complementarily roughly step-shaped in cross-section.

25. The container of claim 16, wherein the container is a food container made of a material suitable for contact with food.

26. The container of claim 25, wherein the material comprises plastic.

27. The container of claim 26, wherein the material comprises foamed plastic.

28. The container of claim 27, wherein the material comprises foamed poly(ethylene terephthalate).

29. The container of claim 27, wherein the material comprises foamed polystyrene.

* * * * *

Disclaimer 6,102,231 — Edward W. Rider, Jr., State Hill; Brian S. Allers, Poughkeepsie, both of N.Y. CANTAINER CLOSURE SYSTEM. Patent dated August 15, 2000. Disclaimer filed January 14, 2002, by the assignee, Genpak, L.L.C.

The term of this patent shall not extend beyond the expiration date of Pat. No. 5,950,854.

*(Official Gazette, April 22, 2003)*